US008096514B1

(12) United States Patent
Stocker

(10) Patent No.: US 8,096,514 B1
(45) Date of Patent: Jan. 17, 2012

(54) BOWL HOLDER SYSTEM

(76) Inventor: Earl G. Stocker, Hudson, FL (US)

( * ) Notice: Subject to any disclaimer, the term of this patent is extended or adjusted under 35 U.S.C. 154(b) by 0 days.

(21) Appl. No.: 12/932,630

(22) Filed: Mar. 2, 2011

Related U.S. Application Data

(63) Continuation-in-part of application No. 12/927,876, filed on Nov. 29, 2010.

(51) Int. Cl.
*A47G 23/00* (2006.01)

(52) U.S. Cl. ..... 248/154; 248/346.07; 269/74

(58) Field of Classification Search ..... 248/309.1, 248/310, 311.2, 313, 316.1, 316.4, 318, 346.06, 248/346.07, 346.11, 154; 269/70, 71, 72, 269/73, 74
See application file for complete search history.

(56) References Cited

U.S. PATENT DOCUMENTS

| | | | | | |
|---|---|---|---|---|---|
| 630,734 | A * | 8/1899 | Oothout | 248/154 |
| 4,549,727 | A * | 10/1985 | Kozar | 248/310 |
| 5,154,380 | A * | 10/1992 | Risca | 248/154 |
| 5,398,898 | A * | 3/1995 | Bever | 248/154 |
| 5,984,291 | A * | 11/1999 | Iwata et al. | 269/73 |
| 6,375,134 | B1 * | 4/2002 | Goldschmidt et al. | 248/154 |
| 6,644,615 | B1 * | 11/2003 | Liu | 248/346.07 |
| 7,090,087 | B1 * | 8/2006 | Guralski | 215/395 |
| 7,494,103 | B1 * | 2/2009 | Huebner | 248/346.07 |

* cited by examiner

*Primary Examiner* — Tan Le

(57) ABSTRACT

A rigid support base has flat parallel top and bottom surfaces separated by a thickness. The support base has a front edge and a parallel rear edge. The support base has parallel first and second side edges. The support base has a plurality of holes including two holes adjacent to the front edge and two holes adjacent to the rear edge. A plurality of rigid rods are provided. Each rod has a lower end received and retained within an associated hole. Each rod is in a cylindrical configuration. Two elevational retainers are provided. Each elevational retainer has two holes slidably received on two rods. The elevational retainer is adapted to contact and hold a bowl on the support base.

2 Claims, 4 Drawing Sheets

64

74
76
72
74
9
9

76
72

72
46
50
48

44
56
54
60
58

7
7

5
5

BOWL HOLDER SYSTEM

RELATED APPLICATION

The present patent application is a continuation-in-part application of pending U.S. patent application Ser. No. 12/927,876 filed Nov. 29, 2010, the subject matter of which is incorporated herein by reference.

BACKGROUND OF THE INVENTION

Field of the Invention

The present invention relates to a bowl holder system and more particularly pertains to releasably receiving and supporting a bowl to facilitate handling by those with reduced motor skills such as younger children, elderly senior citizens and handicapped people, the system being safe, convenient and economical.

SUMMARY OF THE INVENTION

In view of the disadvantages inherent in the known types of xother now present in the prior art, the present invention provides an improved bowl holder system. As such, the general purpose of the present invention, which will be described subsequently in greater detail, is to provide a new and improved bowl holder system and method which has all the advantages of the prior art and none of the disadvantages.

To attain this, the present invention essentially comprises a bowl holder system. First provided is a support base. The support base is in a rectangular configuration. The support base has parallel front and rear edges. The front and rear edges are separated by a length. The support base has parallel first and second side edges. The side edges are separated by a width. The support base has flat parallel top and bottom surfaces. The top and bottom surfaces are separated by a thickness. The support base is fabricated of a rigid plastic material. The support base has six cylindrical exterior holes. The exterior holes include two holes. The two holes are aligned with the front edge. The exterior holes also include two holes. These two holes are aligned with the rear edge. The exterior holes include one hole. The one hole is provided adjacent to each of the first and second side edges. The holes include two horizontal interior holes. The horizontal interior holes are aligned with each of the first and second side edges. Each hole has a diameter of between 0.125 and 0.375 inch.

Four essentially cylindrical rods are provided. Each rod has a diameter of between 0.125 and 0.375 inch. Each rod has a lower end. The lower end is received and retained frictionally and adhesively within an associated exterior hole. Each rod has an upper end. The upper end is located above the top surface of the support base. Each of the rods is fabricated of a rigid plastic material.

A first elevational retainer is provided. The first elevational retainer has two apertures. The two apertures are slidably received over the two rods adjacent to the rear edge of the support base. The first elevational retainer has a linear edge and a second edge. The linear and second edges have a large semicircular configuration. The first elevational retainer has a lower surface. The lower surface is of a common elevation. The first elevational retainer has an upper surface. The upper surface has higher and lower elevations.

A second elevational retainer is provided. The second elevational retainer has two apertures. The two apertures are slidably received over the two rods adjacent to the front edge of the support base. The second elevational retainer has a linear edge and a second edge. The linear edge and second edges are in a small semicircular configuration. The second elevational retainer has a lower surface. The lower surface is of a common elevation. The second elevational retainer has an upper surface. The upper surface has higher and lower elevations.

Provided next are four essentially cylindrical stubs. Each stub has a diameter of between 0.125 and 0.375 inch. Each stub has a lower end. The lower end is received and retained frictionally and adhesively within an associated exterior hole. Each stub has an upper end. The upper end is located above the top surface of the support base. Each of the rods is fabricated of a rigid plastic material.

Further provided are two lateral retainers. Each lateral retainer has two apertures. The two apertures are slidably received over the interior two rods adjacent to one of the side edges of the support base. Each lateral retainer has a linear edge. Each lateral retainer has a second edge. The linear and second edges have a generally circular configuration.

Provided last is a bowl. The bowl has a closed circular bottom. The bowl has an open circular top. The bowl has a frusto-conical side wall. The bowl is fabricated of generally rigid material. In this manner the bowl is adapted to be moved between a supported orientation and an unsupported orientation. The unsupported orientation is with the bowl separated from the support base. The supported orientation is with the bottom of the bowl positioned on the top surface of the support base between the circular edges of the lateral retainers and with the top of the bowl secured beneath and in contact with the elevational retainers.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bowl holder system which has all of the advantages of the prior art xother and none of the disadvantages.

It is another object of the present invention to provide a new and improved bowl holder system which may be easily and efficiently manufactured and marketed.

It is further object of the present invention to provide a new and improved bowl holder system which is of durable and reliable constructions.

An even further object of the present invention is to provide a new and improved bowl holder system which is susceptible of a low cost of manufacture with regard to both materials and labor, and which accordingly is then susceptible of low prices of sale to the consuming public, thereby making such bowl holder system economically available to the buying public.

Even still another object of the present invention is to provide a bowl holder system for releasably receiving and supporting a bowl to facilitate handling by those with reduced motor skills such as younger children, elderly senior citizens and handicapped people, the system being safe, convenient and economical.

Lastly, it is an object of the present invention to provide a new and improved bowl holder system. A rigid support base has flat parallel top and bottom surfaces separated by a thickness. The support base has a front edge and a parallel rear edge. The support base has parallel first and second side edges. The support base has a plurality of holes including two holes adjacent to the front edge and two holes adjacent to the rear edge. A plurality of rigid rods are provided. Each rod has a lower end received and retained within an associated hole. Each rod is in a cylindrical configuration. Two elevational retainers are provided. Each elevational retainer has two holes slidably received on two rods. The elevational retainer is adapted to contact and hold a bowl on the support base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
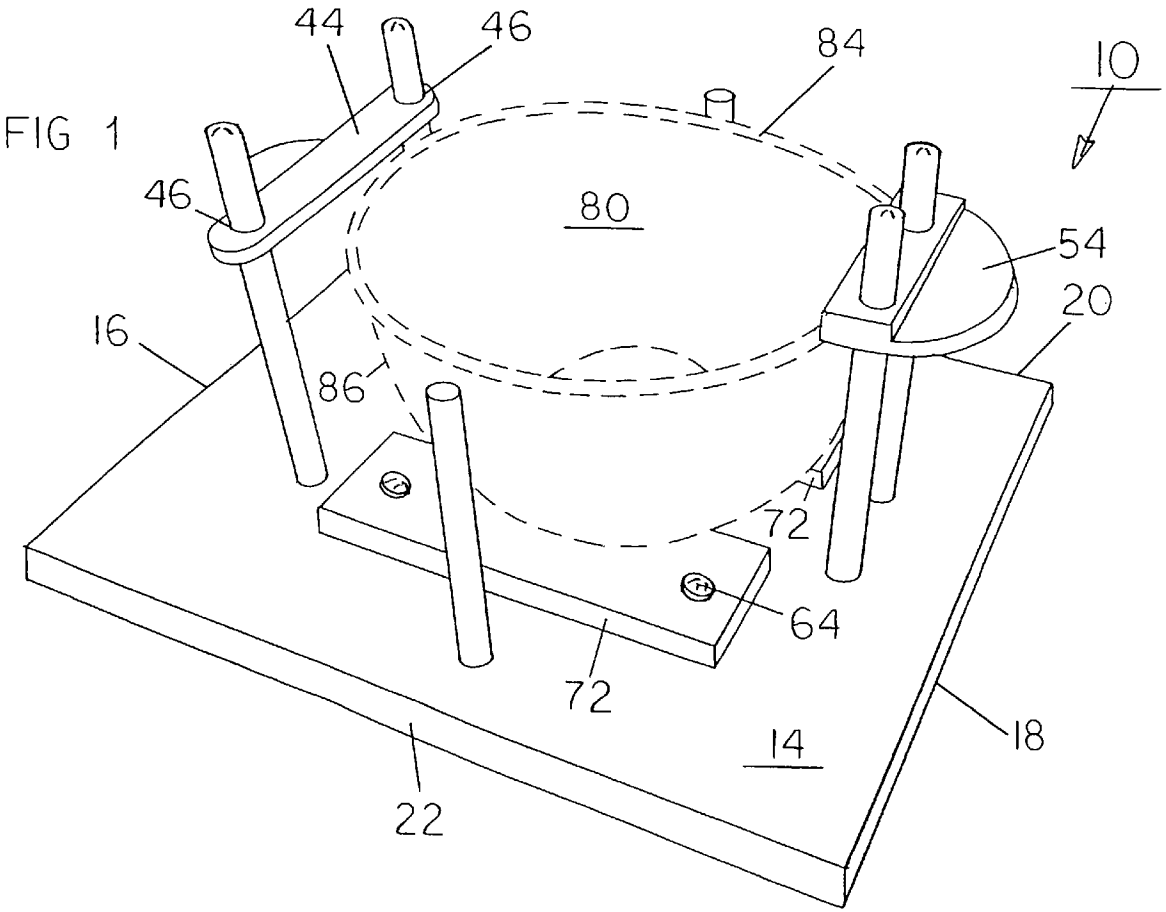
FIG. 1 is a perspective illustration of a bowl holder system constructed in accordance with the principles of the present invention.
Figure 2:
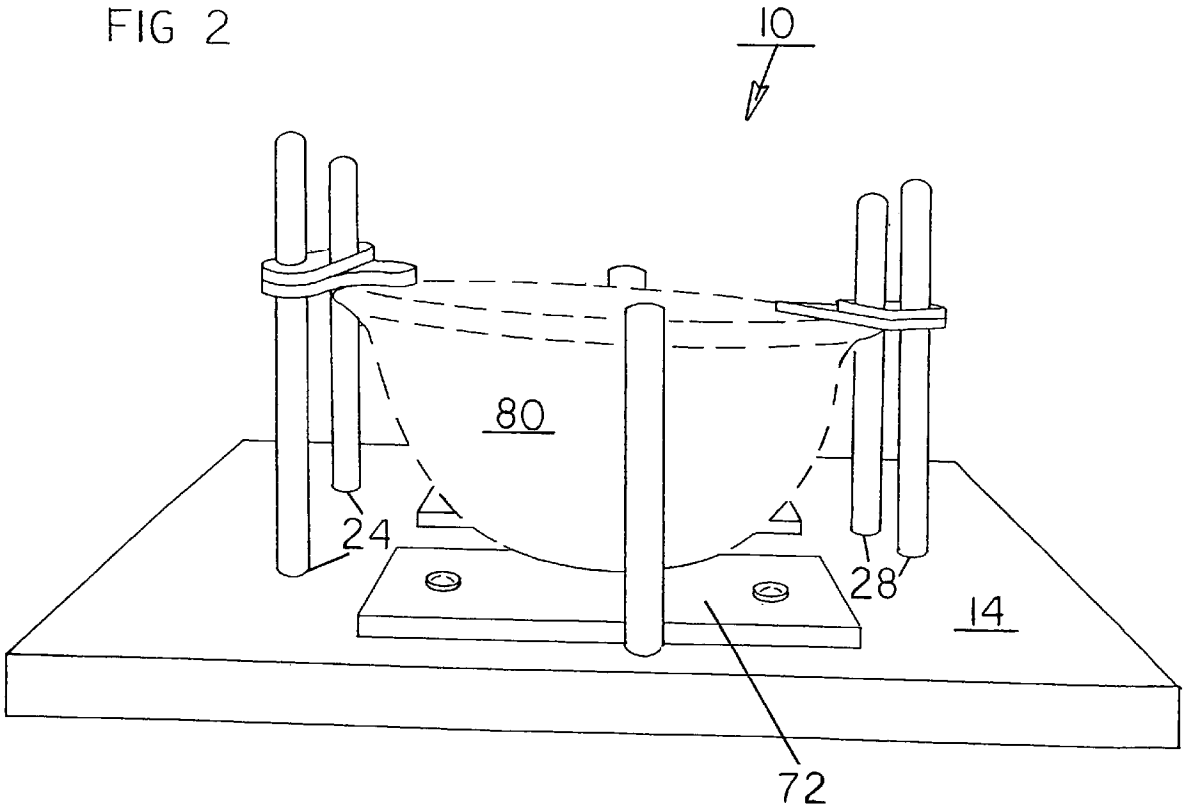
FIG. 2 is an exploded perspective illustration similar to FIG. 1 but with the elevational retainers inverted.
Figure 3:
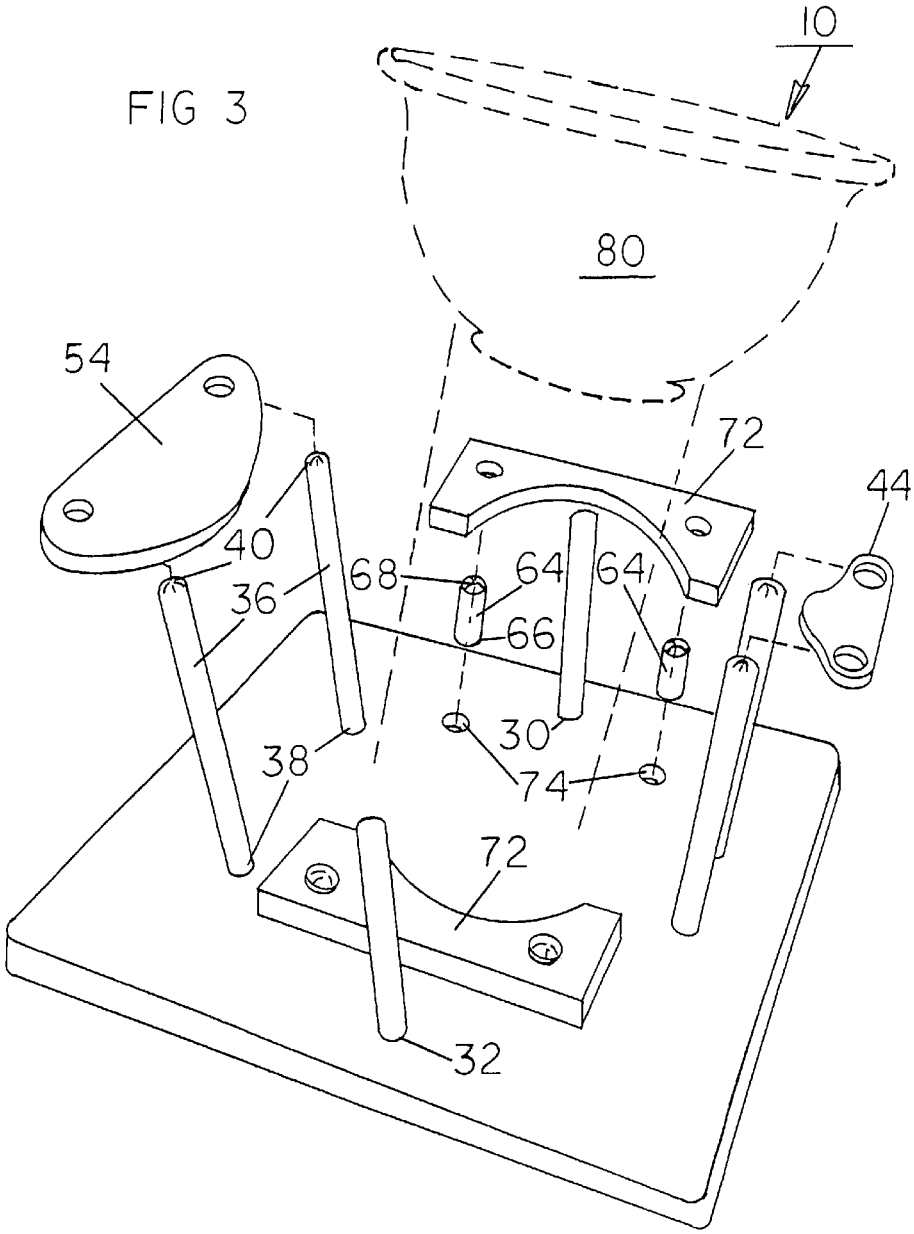
FIG. 3 is an exploded perspective illustration of the system of FIG. 1.
Figures 4, 5, 6, 7, 8, 9, 10, 11:
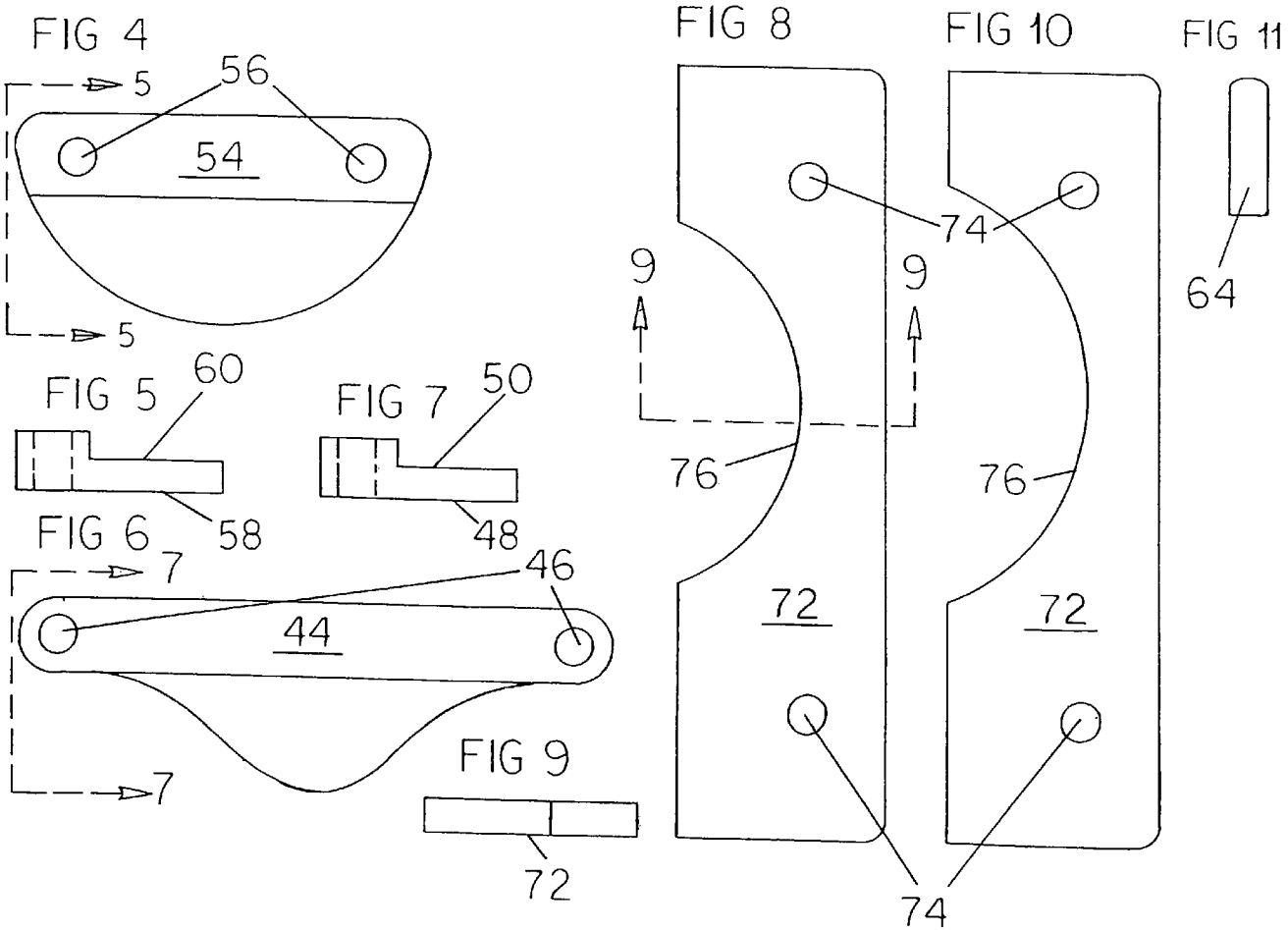
FIG. 4 is a plan view of the first elevational retainer of the prior Figures.
FIG. 5 is an end elevational view taken at line 5-5 of FIGS. 1-3.
FIG. 6 is a plan view of the second elevational retainer shown in FIGS. 1-3.
FIG. 7 is an end elevational view taken at line 7-7 of FIG. 6.
FIG. 8 is a plan view of the first lateral retainer shown in FIGS. 1-3.
FIG. 9 is an end elevational view taken at line 9-9 of FIG. 8.
FIG. 10 is a plan view of the second lateral retainer shown in FIGS. 1-3.
FIG. 11 is a plan view of one stub shown in FIGS. 1-3.

With reference now to the drawings, and in particular to FIG. 1 thereof, the preferred embodiment of the new and improved bowl holder system embodying the principles and concepts of the present invention and generally designated by the reference numeral 10 will be described.

The present invention, the bowl holder system 10 is comprised of a plurality of components. Such components in their broadest context include a rigid support base, a plurality of rigid rods and two elevational retainers. Such components are individually configured and correlated with respect to each other so as to attain the desired objective.

First provided is a support base 14. The support base is in a rectangular configuration. The support base has parallel front and rear edges 16, 18. The front and rear edges are separated by a length. The support base has parallel first and second side edges 20, 22. The side edges are separated by a width. The support base has flat parallel top and bottom surfaces. The top and bottom surfaces are separated by a thickness. The support base is fabricated of a rigid plastic material. The support base has six cylindrical exterior holes. The exterior holes include two holes 24. The two holes are aligned with the front edge. The exterior holes also include two holes 28. These two holes are aligned with the rear edge. The exterior holes include one hole 30, 32. The one hole is provided adjacent to each of the first and second side edges. The holes include two horizontal interior holes. The horizontal interior holes are aligned with each of the first and second side edges. Each hole has a diameter of between 0.125 and 0.375 inch.

Four essentially cylindrical rods 36 are provided. Each rod has a diameter of between 0.125 and 0.375 inch. Each rod has a lower end 38. The lower end is received and retained frictionally and adhesively within an associated exterior hole. Each rod has an upper end 40. The upper end is located above the top surface of the support base. Each of the rods is fabricated of a rigid plastic material.

A first elevational retainer 44 is provided. The first elevational retainer has two apertures 46. The two apertures are slidably received over the two rods adjacent to the rear edge of the support base. The first elevational retainer has a linear edge and a second edge. The linear and second edges have a large semicircular configuration. The first elevational retainer has a lower surface 48. The lower surface is of a common elevation. The first elevational retainer has an upper surface 50. The upper surface has higher and lower elevations.

A second elevational retainer 54 is provided. The second elevational retainer has two apertures 56. The two apertures are slidably received over the two rods adjacent to the front edge of the support base. The second elevational retainer has a linear edge and a second edge. The linear edge and second edges are in a small semicircular configuration. The second elevational retainer has a lower surface 58. The lower surface is of a common elevation. The second elevational retainer has an upper surface 60. The upper surface has higher and lower elevations.

Provided next are four essentially cylindrical stubs 64. Each stub has a diameter of between 0.125 and 0.375 inch. Each stub has a lower end 66. The lower end is received and retained frictionally and adhesively within an associated exterior hole. Each stub has an upper end 68. The upper end is located above the top surface of the support base. Each of the rods is fabricated of a rigid plastic material.

Further provided are two lateral retainers 72. Each lateral retainer has two apertures 74. The two apertures are slidably received over the interior two rods adjacent to one of the side edges of the support base. Each lateral retainer has a linear edge. Each lateral retainer has a second edge 76. The linear and second edges have a generally circular configuration.

Provided last is a bowl 80. The bowl has a closed circular bottom 82. The bowl has an open circular top 84. The bowl has a frusto-conical side wall 86. The bowl is fabricated of generally rigid material. In this manner the bowl is adapted to be moved between a supported orientation and an unsupported orientation. The unsupported orientation is with the bowl separated from the support base. The supported orientation is with the bottom of the bowl positioned on the top surface of the support base between the circular edges of the lateral retainers and with the top of the bowl secured beneath and in contact with the elevational retainers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bowl holder system comprising:

a rigid support base having flat parallel top and bottom surfaces separated by a thickness, the support base having a front edge and a parallel rear edge, the support base having parallel first and second side edges, the support base having a plurality of holes including two holes adjacent to the front edge and two holes adjacent to the rear edge;

a plurality of rigid rods, each rod having a lower end received and retained within an associated hole, each rod being in a cylindrical configuration;

two elevational retainers, each elevational retainer having two holes slidably received on two rods, the elevational retainer adapted to contact and hold a bowl on the support base; and a bowl with a closed circular bottom and an open circular top and a side wall, the bowl being fabricated of generally rigid material whereby the bowl is adapted to be moved between a supported orientation and an unsupported orientation, the unsupported orientation being with the bowl separated from the support base, the supported orientation being with the bottom of the bowl positioned on the top surface of the support base between the circular edges of the lateral retainers and with the top of the bowl secured beneath and in contact with the elevational retainers.

2. A bowl holder (10) for releasably receiving and supporting a bowl to facilitate handling by those with reduced motor skills, the system being safe, convenient and economical, the system comprising, in combination:

a support base (14) in a rectangular configuration having parallel front and rear edges (16), (18) separated by a length, the support base having parallel first and second side edges (20), (22) separated by a width, the support base having flat parallel top and bottom surfaces separated by a thickness, the support base being fabricated of a rigid plastic material, the support base having six cylindrical exterior holes, the exterior holes including two holes (24) aligned with the front edge and two holes (28) aligned with the rear edge, the exterior holes including one hole (30), (32) adjacent to each of the first and second side edges, the holes including two horizontal interior holes aligned with each of the first and second side edges, each hole having a diameter of between 0.125 and 0.375 inch;

four essentially cylindrical rods (36), each rod having a diameter of between 0.125 and 0.375 inch, each rod having a lower end (38) received and retained frictionally and adhesively within an associated exterior hole, each rod having an upper end (40) located above the top surface of the support base, each of the rods being fabricated of a rigid plastic material;

a first elevational retainer (44) with two apertures (46) slidably received over the two rods adjacent to the rear edge of the support base, the first elevational retainer having a linear edge and a second edge with a large semicircular configuration, the first elevational retainer having a lower surface (48) of a common elevation and an upper surface (50) having higher and lower elevations;

a second elevational retainer (54) with two apertures (56) slidably received over the two rods adjacent to the front edge of the support base, the second elevational retainer having a linear edge and a second edge with a small semicircular configuration, the second elevational retainer having a lower surface (58) of a common elevation and an upper surface (60) having higher and lower elevations;

four essentially cylindrical stubs (64), each stub having a diameter of between 0.125 and 0.375 inch, each stub having a lower end (66) received and retained frictionally and adhesively within an associated exterior hole, each stub having an upper end (68) located above the top surface of the support base, each of the rods being fabricated of a rigid plastic material;

two lateral retainers (72), each lateral retainer having two apertures (74) slidably received over the interior two rods adjacent to one of the side edges of the support base, each lateral retainer having a linear edge and a second edge (76) with a generally circular configuration; and a bowl (80) with a closed circular bottom (82) and an open circular top (84) and a frusto-conical side wall (86), the bowl being fabricated of generally rigid material whereby the bowl is adapted to be moved between a supported orientation and an unsupported orientation, the unsupported orientation being with the bowl separated from the support base, the supported orientation being with the bottom of the bowl positioned on the top surface of the support base between the circular edges of the lateral retainers and with the top of the bowl secured beneath and in contact with the elevational retainers.

* * * * *